United States Patent [19]

Leach et al.

[11] Patent Number: 4,862,639

[45] Date of Patent: Sep. 5, 1989

[54] DRIVE-IN WINDOW

[75] Inventors: Richard M. Leach, Willard; David W. B. Miles, Fair Grove, both of Mo.

[73] Assignee: Brampton Enterprises, Inc., Springfield, Mo.

[21] Appl. No.: 194,434

[22] Filed: May 13, 1988

[51] Int. Cl.[4] ..... E05C 17/00

[52] U.S. Cl. ..... 49/122; 49/102

[58] Field of Search ..... 49/101, 109, 122, 357, 49/366, 449

[56] References Cited

U.S. PATENT DOCUMENTS

| | | | |
|---|---|---|---|
| 2,206,051 | 7/1940 | Roof | 49/109 X |
| 2,465,555 | 3/1949 | Smith | 49/109 X |
| 2,670,952 | 3/1954 | Bushnell | 49/109 |
| 4,302,908 | 12/1981 | Parker | 49/122 |
| 4,614,059 | 9/1986 | Traupe | 49/122 X |

*Primary Examiner*—James R. Brittain

*Attorney, Agent, or Firm*—Alan B. Samlan

[57] ABSTRACT

A serving window for installation in drive-through facilities such as fast food restaurants is disclosed. The window unit comprises two window members carried by rotatable shafts and set in a support frame, preferably of stainless steel, with an operating mechanism mounted within the sill of the support frame and operable electrically or manually by applying pressure to a bump bar mounted on the inside of the window frame or to a foot pedal linked to the operating mechanism by a hidden cable. The operating mechanism consists of a pivotal crossbar mounted horizontally on the support frame and secured on each end to an "L" shaped crank arm arrangement connected to a corresponding window shaft. When the mechanism is activated, the crossbar oscillates within the limited confines of the window frame and effects full opening of the windows in synchronism upon slight pressure applied to the bump bar or one of the other means of operation. Release of pressure on the bump bar automatically closes the windows. Because there are no belts, straps or pulleys and cables, the operating mechanism is less expensive to manufacture and install and has fewer moving parts to service or replace.

12 Claims, 2 Drawing Sheets

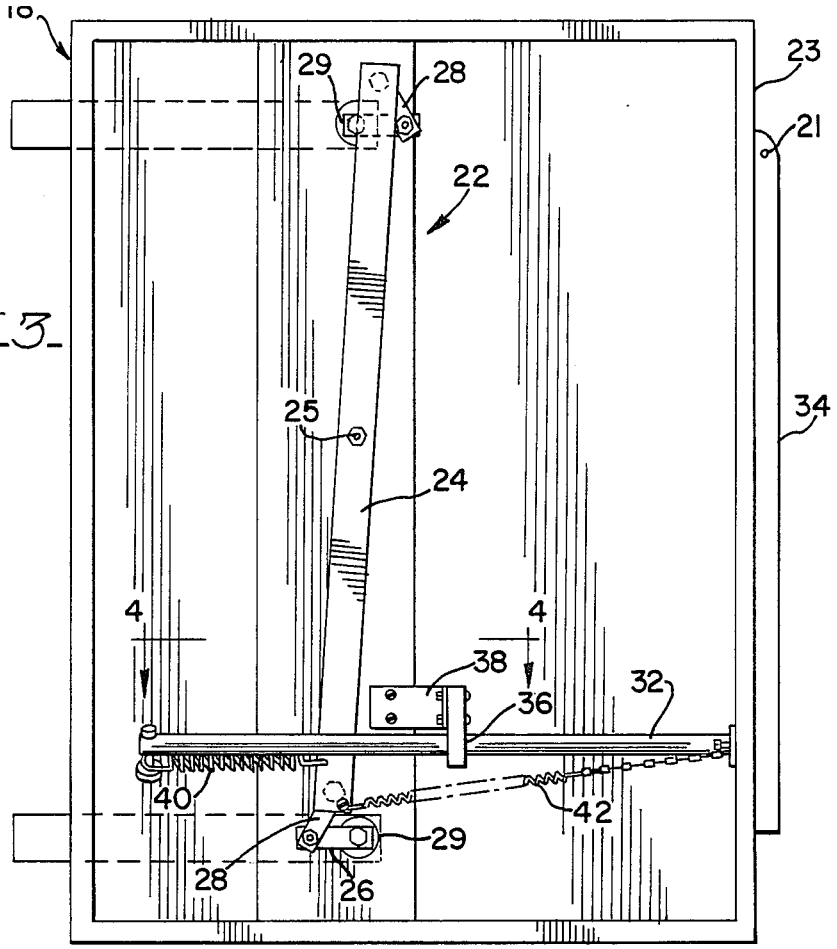
FIG. 3
FIG. 4
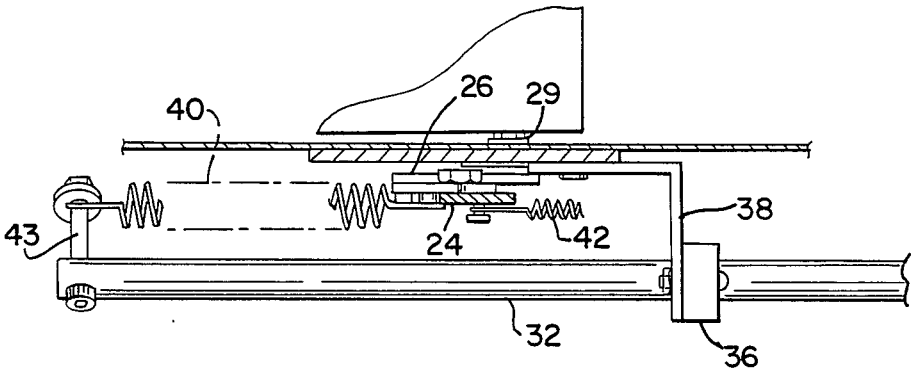

DRIVE-IN WINDOW

BACKGROUND OF THE INVENTION

This invention relates to serving windows and more particularly, to serving windows and similar openings installed in drive-through or walk-up facilities such as fast food restaurants to facilitate exchange between the customer and the business without exposing the server to risk from the customer or the weather. Such windows are usually mounted in the wall of a facility at a height which will put the server in convenient reaching distance from a customer seated in a vehicle, and are commonly used for fast food restaurants and other businesses with drive-through service.

The windows presently in use in most drive-through facilities operate by use of a cable/pulley or block and tackle mechanism mounted within the bottom frame of the window unit and have frequent breakdowns due to the extreme wear and tear caused by continuous opening and closing of the windows. These equipment breakdowns and repairs or replacements are costly for the business owner both in equipment costs and "down" time for repairs.

The present invention responds to the disadvantages set forth above by employing a pivotal operating mechanism self-contained within the framework of the window unit and directly attached to the two window shafts. There are no belts or straps to break or stretch and the stress-tested mechanism gives greater reliability, is of higher quality, and costs less to install and maintain.

Additionally the unit of the present invention is easy to operate and offers a variety of enabling devices, including electrical with battery back-up, or body, hand or foot activated. A preferred embodiment is operated by means of an upholstered bump bar at hip level which fully opens the windows upon a two-inch movement of the bump bar. All of the enabling devices provide automatic closure of the windows upon release of pressure.

It is, therefore, the primary object of this invention to provide a service window with an operating mechanism that does not have the disadvantages heretofore recited and which is capable of effectively opening and closing the service window repetitively with minimal breakdown and replacement of parts, and with ease and variety of operation.

It is a further object of this invention to provide a service window wherein an operating mechanism is provided that is contained within the bottom support frame of the window.

A more particular object of this invention is to provide an operating mechanism for a service window, as aforesaid, which comprises a horizontal crossbar secured at its midpoint to the underside of the support frame by means of an arrangement that allows the crossbar to freely pivot on an upright axis, and connected at each end to cranks on the shafts of the window members, whereby the crossbar oscillates in response to pressure on the enabling means to synchronously open and close the windows.

Another object of this invention is to provide an operating mechanism for a service window, as aforesaid, wherein the crossbar is connected adjacent one end with a push/pull operating rod so that force on the rod applied by an enabling device causes the crossarm to swing and thereby open the window members of the window unit.

Yet another object of this invention is to provide an operating mechanism for a service window, as aforesaid, wherein the crossbar is stabilized by impact-reducing springs, so that sudden or excessive force on the operating rod does not over extend and damage the windows or operating mechanism, the force of movement of the windows being accordingly limited and cushioned by the action of the springs. The push/pull rod may extend through the bottom frame where it would be connected to a horizontally mounted, cushioned bump bar, or it may be fastened to a cable extending from the frame to the floor for attachment to a foot pad.

BRIEF DESCRIPTION OF THE DRAWINGS

FIG. 3 is a bottom plan view showing the operating mechanism contained within the support frame, with the bump bar activated and the windows open, the fully open position of the windows being shown in broken lines.

FIG. 4 is an enlarged, fragmentary view of the mechanism, taken along line 4—4 of FIG. 3, and showing features of the mechanism in deatil.

DESCRIPTION OF THE PREFERRED EMBODIMENT

Figure 1:
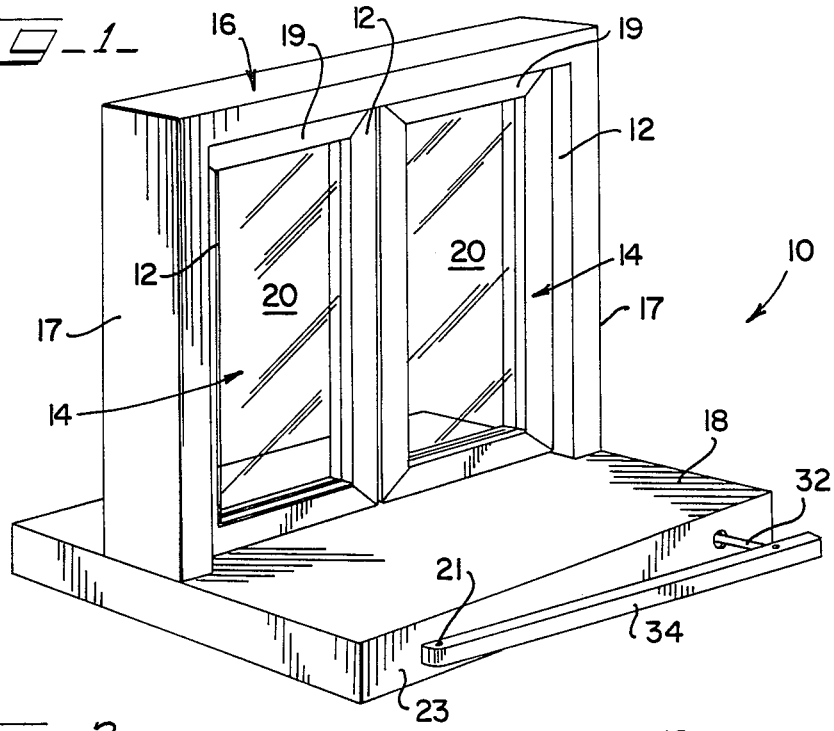
FIG. 1 is a perspective view of a serving window incorporating the present invention, with the windows closed and a bump bar shown in its normal position.

Referring to the drawings, FIG. 1 shows a serving window 10 with the two window members 14 in a closed position. The aluminum main frame 16 is preferably of anodized bronze or may be made of clear anodized material. The glass 20 is ¼" clear or bronze tempered glass. The window members 14 fit within a weather seal fin 12 built into the respective sides 17 and top of the interior of the main frame 16 to provide a tight, positive seal. The window members 14 are framed by metal frames 19, preferably of stainless steel for ease of maintenance and strength. If desired, though not shown, one window member 14 may be provided with an extra stainless strip attached vertically to the center of the outside frame 19 to overlap and totally seal any center gap remaining when the window members 14 are in a closed position.

Each of the window members 14 is carried by a vertical shaft housed within the respective side 17 of the main frame 16, the lower end of each shaft being seen at 29 (FIGS. 2 and 3) terminating within a sill housing 18 at the bottom of main frame 16. An operating mechanism 22 is concealed within the sill housing 18 except for an actuating bump bar 34 pivotally mounted at 21 on the interior end wall 23 of the housing 18 and operable upon hip pressure against the bump bar 34 which is attached to a push/pull rod 32. The window members 14 open fully when the push/pull rod 32 is pushed inwardly two inches and close automatically when pressure is released. The push/pull rod 32 may be activated by other actuating means (not shown) such as a foot pedal connected by cable means to the rod 32, or electrically operated actuating means.

Figure 2:
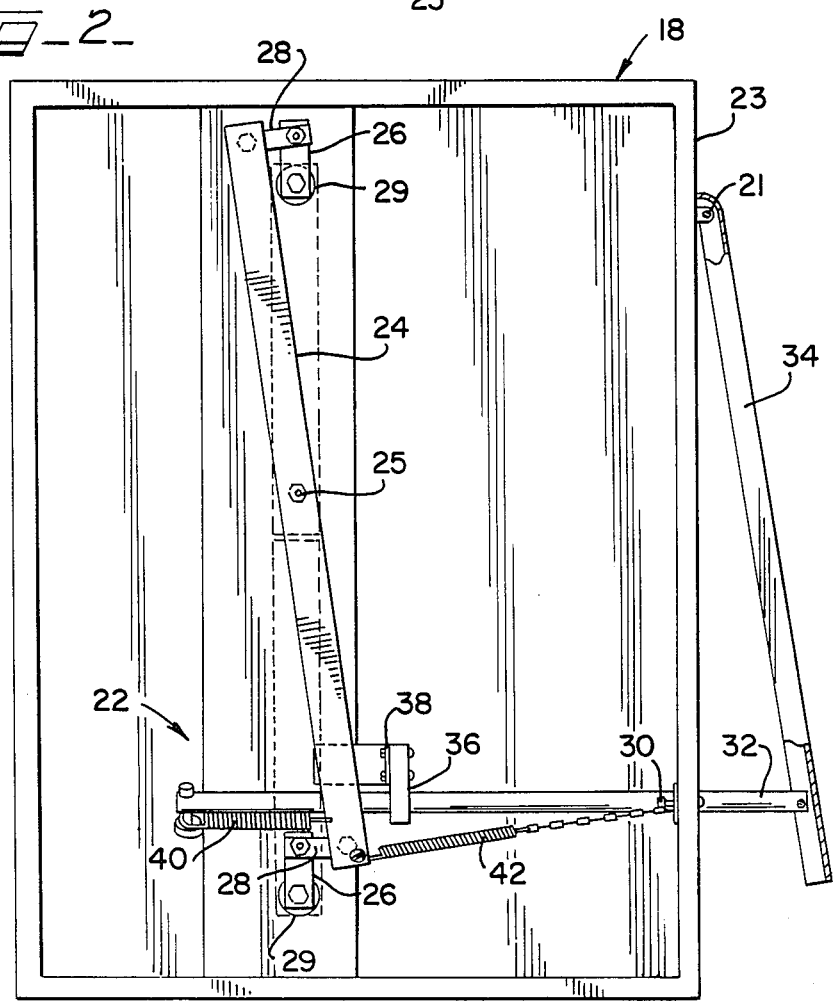
FIG. 2 is a bottom plan view showing the operating mechanism contained within the support frame, with the windows closed and shown in broken lines.

The operating mechanism 22 which is shown in detail in FIG. 2 consists of two crank arms 26 fixed to respective shafts 29 and forming part of an "L" linkage completed by pivotal links 28 connected to the opposed ends of a horizontal cossbar 24 which is intermediately mounted within the sill housing 18. The crossbar 24 oscillates about a vertical axis provided by a pivot pin 25 at the midpoint of crossbar 24. When the window members 14 are shut, the crank arms 26 and links 28 are disposed at essentially right angles, those angles becoming acute upon application of force by the actuating means 34 which causes rotation of the links 28 on the crank arms 26 in response to rotation of the crossbar 24 from its normal position shown in FIG. 2 to its operated position shown in FIG. 3, thus achieving a full 90% rotation of the window members 14 about their shafts 29 to synchronously open the window members 14 outwardly as shown by the broken lines of FIG. 3.

The operating mechanism 22 includes yieldable means, such as demonstrated by coil spring 40 and a stabilizing spring 42, which are both secured to one end of the crosssbar 24 for the purpose of reducing impact to the operating mechanism when sudden or excessive force is applied to the actuating means 34 to shift the push rod 32 and activate the crank arm linkage. FIG. 2 shows coil spring 42, extending between an anchor 30 on the sill housing and the lower end (as viewed in FIG. 2) of the crossbar 24, in its relaxed position. FIG. 3 demonstrates coil spring 42 when force has been applied to the push rod and coil spring 42 is extended to absorb rapid impact or excessive force applied to the bump bar and to ensure that all components of the mechanism 22 operate smoothly, thereby preventing excessive wear and tear.

An additional yieldable coupling presented by the coil spring 40, is attached to the push rod 32 by means of a bolt 43 through the inner end of the push rod to which coil spring 40 is attached. This spring also attenuates in response to inward movement of rod 32, thereby causing restriction of the push/pull rod in its path of travel to limit shock to the operating mechanism 22 caused by the application of excessive force.

By reference to FIGS. 2 and 3 it can be seen that the push/pull rod 32 is received by an apertured block or guide 36 which is secured to the frame by means of an angle bracket 38 shown in FIG. 3 and in enlarged detail in FIG. 4.

The simplicity of the design and the minimal number of moving parts act to reduce maintenance and ensure long life of the operating mechanism. The moving parts are preferably mounted in oilite bushings for long life and the mechanism can be manufactured entirely of steel and plated to prevent rust. The window members 14 ride on thrust bearings and washers, thus allowing the members 14 to swing smoothly and easily about the axes of their shafts. Top and bottom locking devices (not shown) are used to secure the windows in a closed position when not in use.

Having thus described the invention, what is claimed as new and desired to be secured by Letters Patent is:

1. In a serving window:

a pair of swingable window members each carried by an upright shaft, frame means receiving said window members and supporting said shafts, and presenting a sill housing beneath said window members to which said shafts extend, an operating mechanism in said housing for opening and closing said window members, including a crank arm on each of said shafts, respectively, a crossbar having means at its opposed ends connecting said crossbar with corresponding crank arms, and means intermediate said ends mounting said crossbar for oscillation about a transverse axis to synchronously open and close said window members, said crossbar having a normal position in which the window members are closed and an operated position in which they are open, and actuating means comprising a shiftable component extending within said housing, and yieldable means interconnecting said component and said crossbar for reducing impact on the operating mechanism upon application of a sudden or excessive force to said component with the actuating means operable from outside said housing for shifting said crossbar from said normal to said operated position.

2. The serving window as claimed in claim 1, wherein said connecting means at the ends of the crossbar include a pair of links pivotally connecting respective ends with the corresponding crank arms, whereby each crank arm and corresponding link present an "L" linkage operatively connecting the crossbar with the shafts.

3. The serving window as claimed in claim 1, wherein said axis of oscillation of the crossbar is upright and disposed substantially midway between said ends of the crossbar.

4. The serving window as claimed in claim 3, wherein said connecting means at the ends of the crossbar include a pair of links pivotally connecting respective ends with the corresponding crank arms, whereby each crank arm and corresponding link present an "L" linkage operatively connecting the crossbar with the shafts.

5. The serving window as claimed in claim 4, further comprising a resilient element connected between said crossbar and said frame means for stabilizing the operating mechanism during oscillation of said crossbar.

6. The serving window as claimed in claim 1, wherein said component is a push rod extending transversely of said crossbar, said yieldable means including a resilient element interconnecting said rod with said crossbar adjacent one of said ends thereof.

7. The serving window as claimed in claim 1 and further comprising a bump bar on said housing connected with said component for shifting the latter in response to movement of said bump bar by an operator.

8. In a serving window:

a pair of swingable window members each carried by an upright shaft, frame means receiving said window members and supporting said shafts, and presenting a sill housing beneath said window members to which said shafts extend, an operating mechanism in said housing for opening and closing said window members, including a crank arm on each of said shafts, respectively, a crossbar having means at its opposed ends connecting said crossbar with corresponding crank arms, and means intermediate said ends mounting said crossbar for oscillation about a transverse axis to synchronously open and close said window members, said crossbar having a normal position in which the window members are closed and an operated position in which they are open, and actuating means operable from outside said housing for shifting said crossbar from said normal to said operated position and a resilient element connected between said crossbar and said frame means for stabilizing the operating mechanism during oscillation of the crossbar.

9. The serving window as claimed in claim 8, wherein said axis of oscillation of the crossbar is upright and disposed substantially midway between said ends of the crossbar.

10. The serving window as claimed in claim 8, wherein said connecting means at the ends of the crossbar include a pair of links pivotally connecting respective ends with the corresponding crank arms, whereby each crank arm and corresponding link present an "L" linkage operatively connecting the crossbar with the shafts.

11. The serving window as claimed in claim 8, wherein said actuating means includes a shiftable component extending within said housing, and yieldable means interconnecting said component and said crossbar for reducing impact on the operating mechanism upon application of a sudden or excessive force to said component.

12. The serving window as claimed in claim 11, wherein said component is a push rod extending transversely of said crossbar, said yieldable means including a second resilient element interconnecting said rod with said crossbar adjacent one of said ends thereof.

* * * * *